US008519310B2

(12) United States Patent
Pinkert

(10) Patent No.: US 8,519,310 B2
(45) Date of Patent: Aug. 27, 2013

(54) COOKING APPLIANCE

(75) Inventor: Matthias Pinkert, Dresden (DE)

(73) Assignee: Aktiebolaget Electrolux, Stockholm (SE)

( * ) Notice: Subject to any disclaimer, the term of this patent is extended or adjusted under 35 U.S.C. 154(b) by 257 days.

(21) Appl. No.: 12/978,515

(22) Filed: Dec. 24, 2010

(65) Prior Publication Data

US 2011/0163084 A1 Jul. 7, 2011

Related U.S. Application Data

(63) Continuation-in-part of application No. PCT/SE2009/000321, filed on Jun. 23, 2009.

(30) Foreign Application Priority Data

Jun. 24, 2008 (SE) ..... 0801.482

(51) Int. Cl.

| | |
|---|---|
| ***H05B 6/02*** | (2006.01) |
| ***H05B 6/12*** | (2006.01) |
| ***H05B 6/06*** | (2006.01) |
| ***H05B 6/16*** | (2006.01) |
| ***H05B 6/04*** | (2006.01) |
| ***H05B 6/08*** | (2006.01) |
| ***H05B 3/10*** | (2006.01) |

(52) U.S. Cl.

USPC ..... 219/601; 219/620; 219/622; 219/623; 219/624; 219/627; 219/650; 219/655; 219/656; 219/662; 219/663; 219/664; 219/553

(58) Field of Classification Search

USPC ..... 219/601, 620, 622–624, 627, 650, 219/655–656, 662–664, 553

See application file for complete search history.

(56) References Cited

U.S. PATENT DOCUMENTS 5,847,365 A * 12/1998 Harter et al. ..... 219/492
6,119,678 A * 9/2000 Marchand ..... 126/39 B (Continued)

FOREIGN PATENT DOCUMENTS

| | | |
|---|---|---|
| DE | 20103517 | 6/2001 |
| DE | 102006039087 | 2/2008 |
| EP | 1528327 | 5/2005 |
| GB | 2277799 | 11/1994 |

OTHER PUBLICATIONS

International Search Report for PCT/SE2009/000321, 4 sheets, dated Sep. 15, 2009.

*Primary Examiner* — Joseph M Pelham
*Assistant Examiner* — Gyounghyun Bae
(74) *Attorney, Agent, or Firm* — Banner & Witcoff, Ltd.

(57) ABSTRACT

A cooking appliance. The cooking appliance includes a cook top for a kitchen. One side of the cook top includes a cooking area with cooking areas. The cooking areas may be operated via an induction cooker. The bottom side of the cooking appliance has a display. The display can provide useful information thereon such as the time. The cook top can be arranged in a first horizontal position for use of the cooking areas, and folded to a second vertical position during non use to display information on the display. The cooking appliance also includes a data reader, such as an RFID reader or bar code scanner to obtain data from a food product package. The data may include suggested recipes, cooking temperatures, and/or cooking times. The obtained data may be used to assist in controlling the operation of the cooking areas.

11 Claims, 5 Drawing Sheets

(56) References Cited

U.S. PATENT DOCUMENTS

| | | | | |
|---|---|---|---|---|
| 6,271,504 | B1 * | 8/2001 | Barritt | 219/452.13 |
| 6,399,925 | B1 * | 6/2002 | Pickering et al. | 219/452.13 |
| 6,759,636 | B2 * | 7/2004 | Stutman | 219/679 |
| 6,953,919 | B2 | 10/2005 | Clothier | |
| 7,060,953 | B2 * | 6/2006 | Ishikawa et al. | 219/702 |
| 7,102,107 | B1 * | 9/2006 | Chapman | 219/494 |
| 7,301,127 | B1 * | 11/2007 | Derridinger, Jr. | 219/386 |
| 7,355,150 | B2 * | 4/2008 | Baarman et al. | 219/620 |
| 7,372,003 | B2 * | 5/2008 | Kates | 219/494 |
| 2002/0008632 | A1 * | 1/2002 | Clothier | 340/825.37 |
| 2004/0149736 | A1 * | 8/2004 | Clothier | 219/627 |
| 2006/0249506 | A1 * | 11/2006 | Robertson | 219/450.1 |

* cited by examiner

COOKING APPLIANCE

CROSS REFERENCE TO RELATED APPLICATION

This application is a continuation-in-part of International Application No. PCT/SE2009/000321 filed Jun. 23, 2009 entitled COOKING APPLIANCE, which claims priority from Swedish Application No. 0801.482-1 filed Jun. 24, 2008 entitled COOKING APPLIANCE, the entire contents of both are incorporated herein by reference.

FIELD AND BACKGROUND

The disclosure relates to a cooking appliance having a cook top. In modern times, it is not uncommon for many busy people living in small living quarters, such as small apartments, to have less available kitchen space and less available time. As their working area is very limited to prepare any food, sinks and cook tops limit food preparation activities like cutting vegetables or kneading dough. A kitchen appliance that would help to save significant space in a small kitchen area would therefore be beneficial in enabling the user to cook and to make them more comfortable during the cooking process.

BRIEF SUMMARY

Aspects of the disclosure pertain to a cooking appliance having a cook top. The cook top includes a cooking area on a top side and a display on a bottom side. The cook top is movable between a first position for using the cooking area and a second position for non-cooking which exposes the display. If desired, the display may include a clock to provide the time. Also, if desired, the first position may be substantially horizontal and the second position may be substantially vertical.

BRIEF DESCRIPTION OF THE DRAWINGS

The foregoing summary as well as the following detailed description, considered in conjunction with the accompanying drawings, provide a better understanding, in which like reference numbers refer to like elements, and wherein.

DETAILED DESCRIPTION

Figure 1:
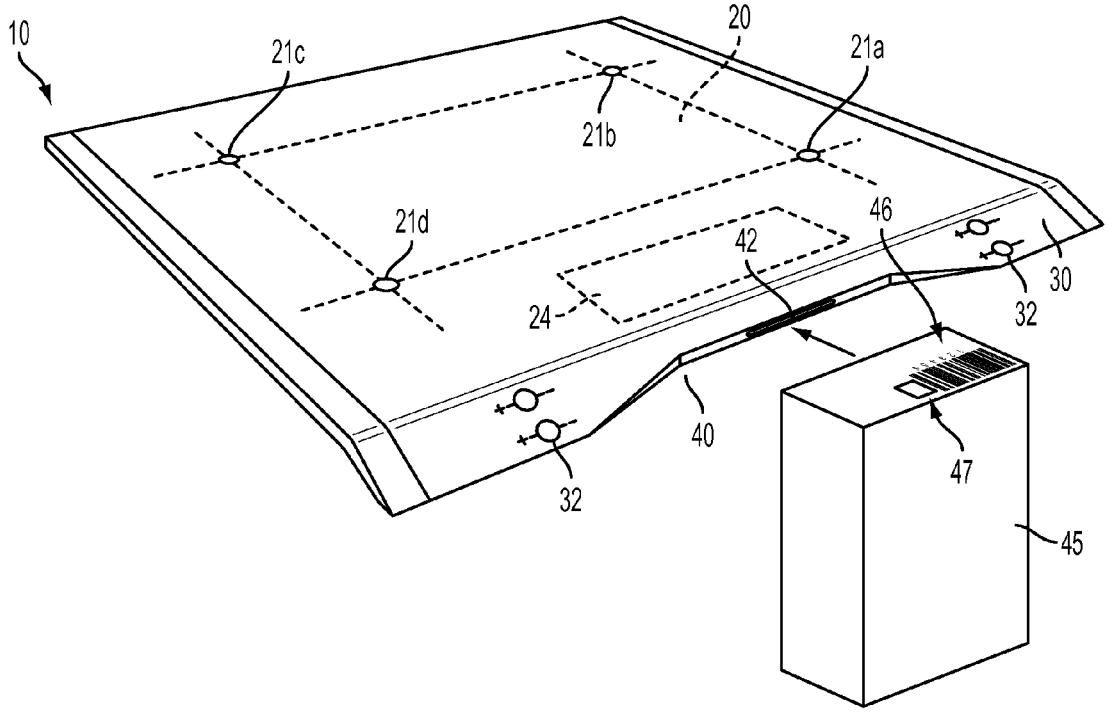
FIG. 1 is a perspective view of a cooking appliance according to an embodiment of the disclosure shown with a food package.
Figure 2:
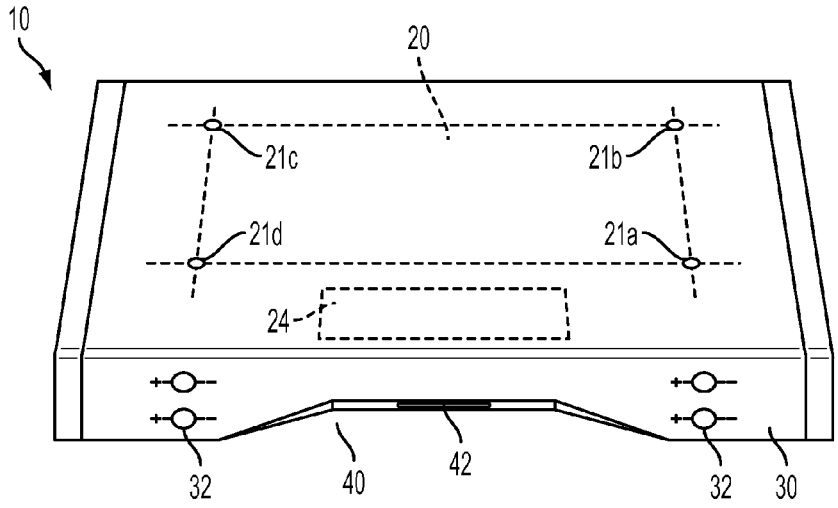
FIG. 2 is a front perspective view of the cooking appliance.
Figure 3:
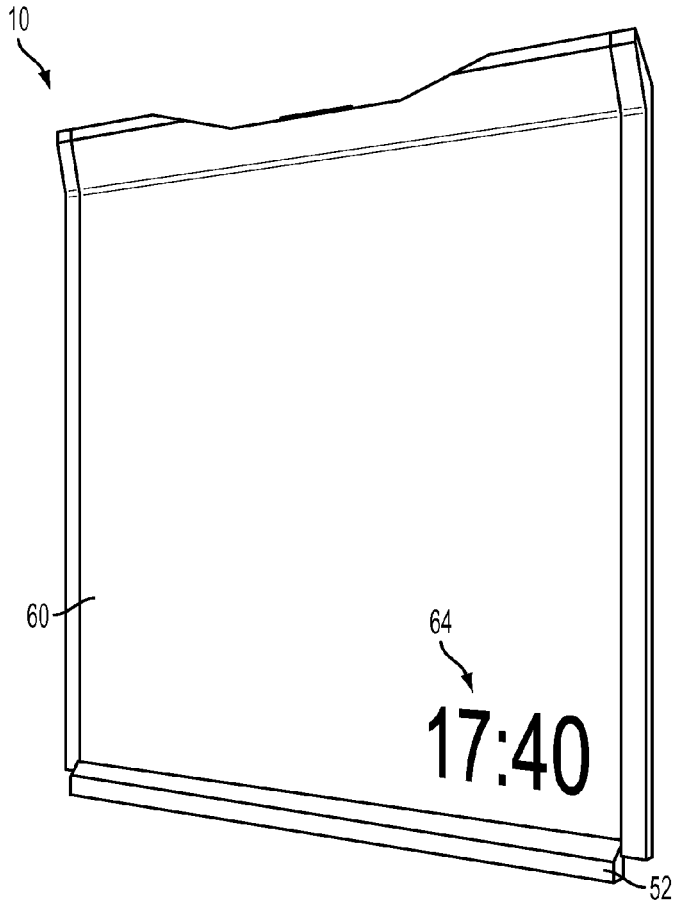
FIG. 3 is a perspective rear view of the cooking appliance in an alternative position for storage.

FIGS. 1-5 illustrate details of a cooking appliance 10 according to an embodiment of the disclosure. According to the depicted embodiment, the cooking appliance 10 is movable between an in-use position (such as shown in FIGS. 1-2) and a storage position (such as shown in FIG. 3). The cooking appliance 10 is a cooking device and includes a cook top surface 20 for resting for cooking food in pots, pans, etc. The cooking device may be an induction cooker and the cook top surface 20 includes four induction cooking areas 21*a*, 21*b*, 21*c*, and 21*d*. Suitable markers or indicia may be provided on the top surface 20 to visually designate the cooking area 21*a*, 21*b*, 21*c*, and 21*d*.

Figure 4:
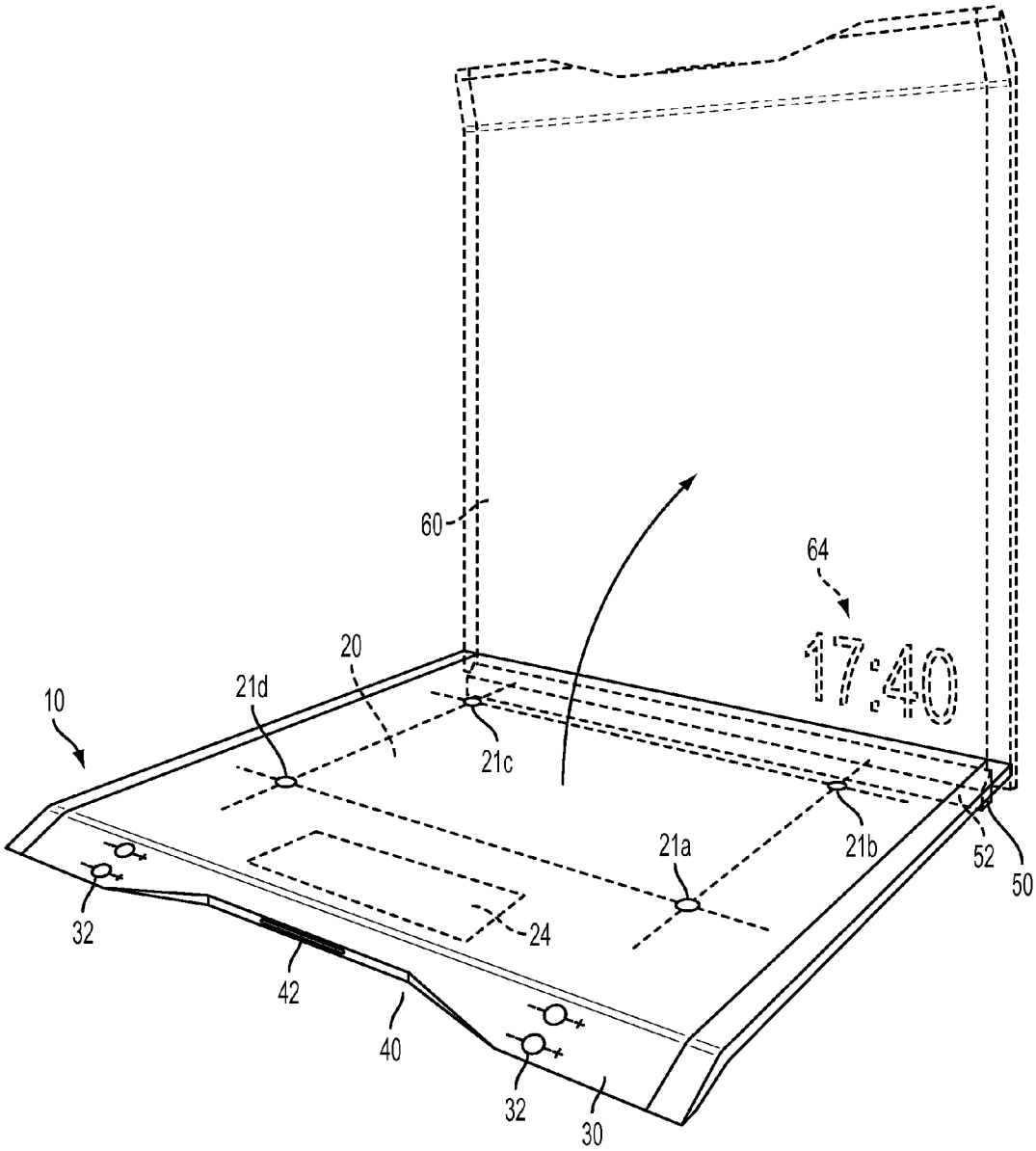
FIG. 4 is a perspective view of the cooking appliance showing the relationship between an in use and a storage position.

In the depicted embodiment, the cooking appliance 10 also includes a beveled front edge 30. As can be seen in FIGS. 1, 2, and 4, user controls 32 for the induction cooking areas 21*a*, 21*b*, 21*c*, and 21*d* can be located on the beveled front edge 30. In a preferred but not required embodiment, the user controls 32 are touch sensitive-type controls. If desired, an individual user control 32 may be provided for each of the cooking areas 21*a*, 21*b*, 21*c*, and 21*d*.

The cook top surface 20 of the cooking appliance 10 may include a display 24 thereon. The display 24 is safely spaced from the four induction cooking areas 21*a*, 21*b*, 21*c*, and 21*d*. The display 24 may provide data associated with the cooking process including cook time, cook temperature, and/or a food recipe. Suitable additional touch sensitive user controls 32 may also be provided for selecting or modifying data in the display 24. If desired, a suitable graphical user interface (not shown) may be provided in the display 24.

The cooking appliance 10 also includes a data reader 42. The data reader 42 can include an RFID reader. Alternatively and/or additionally, the data reader 42 can include a bar code scanner. As can be seen in FIGS. 1, 2, and 4, the beveled front edge 30 may have a central notch 40 therein. The data reader 42 may be located in the notch 40 as shown. The data reader 42 is coupled to a controller (not shown) on the cooking appliance 10.

Figure 6:
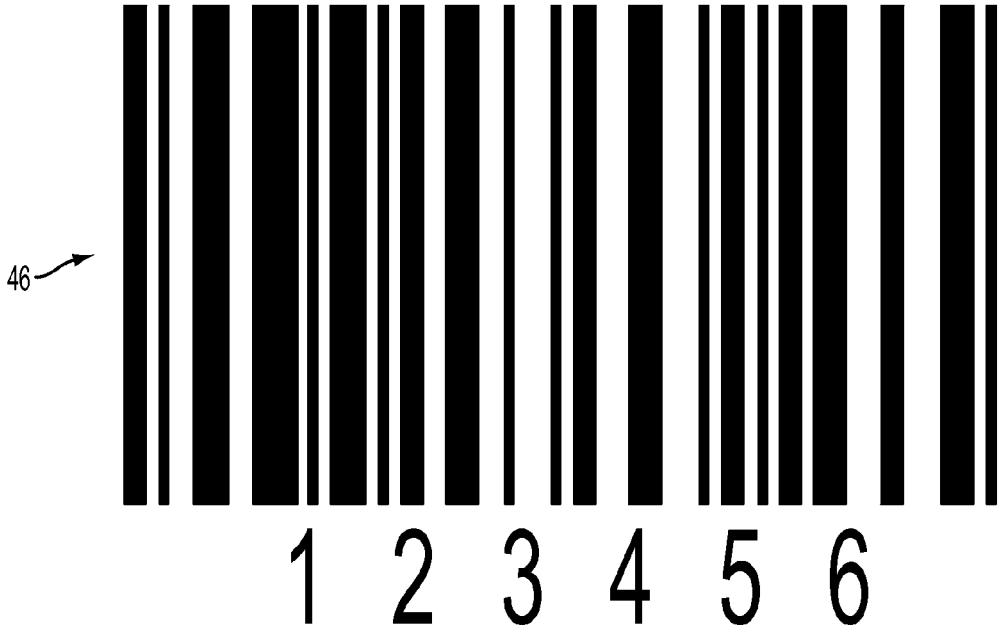
FIG. 6 is a front view of an illustrative bar code usable on a food package.
Figure 7:
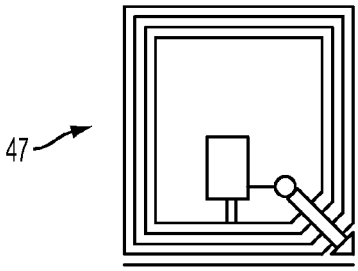
FIG. 7 is a front view of an illustrative RFID tag usable on a food package.

Many food packages include bar codes thereon. An illustrative example of a bar code 46 is shown in FIG. 6. Additionally, in the future, it is expected that many food packages will include an RFID chip thereon or therein. An illustrative and schematic example of an RFID chip 47 is shown in FIG. 7. In some instances, the RFID chip 47 may contain information about the product therein including the cooking time, cooking temperature, ingredients, and recipe suggestions.

In use, and as shown in FIG. 1, the user moves a food product package 45 adjacent the data reader 24 and holds it there for reading. Assuming the package includes an RFID tag or chip 47, the data reader 24 will acquire data associated with the food in the package 45 such as the suggested cooking time, the suggested cooking temperature, suggested ingredients to add, and/or suggested recipes. This data may be displayed in display 24.

For example, if the product package 45 contains a pasta sauce, the RFID tag or chip 47 may provide the controller with default information that the user is trying to cook pasta Bolognese, and that one of the cooking zones 21*a*, 21*b*, 21*c*, or 21*d* should be turned on to a suitable designated level to heat the sauce such as 158° F. (70° C.).

The user can decide if he wants to start the cooking process immediately based on the default values provided with the food package 45. Alternatively, a user may modify the default instructions provided by the food package 45. For example, the user can modify the temperature, time, or recipe.

After cooking, the cooking appliance automatically turns off the controls to the cooking zones 21*a*, 21*b*, 21*c*, or 21*d*. Under this arrangement, from the initial reading of the package 45 through the cooking process, the cooking appliance 10 has the ability to take over the control of cooking temperature and cooking time and facilitate the cooking process.

If a food package 45 includes a bar code 46 thereon, the controller may look up the bar code number as read by the data reader 42 in a database in data memory or via the Internet should the product be coupled to the Internet. From a data lookup, data associated with the food in the package 45 such as the suggested cooking time, the suggested cooking temperature, suggested ingredients to add, and/or suggested recipes may be displayed in display 24. The user may then proceed with the operation as previously described.

As shown in FIG. 3, a bottom surface 60 of the cooking appliance 10 (the side of the cooking appliance 10 opposite the cook top surface 20) includes a display 64. The display may include any desirable information such a clock displaying the time. If the cooking appliance is connected to the Internet, the display 64 may display supplemental information such as the weather, news stories, or other information. It is recognized that the display may be an LED, LCD, or any other suitable display.

FIG. 4 shows the cook top of the cooking appliance 10 in a use or position in solid lines and a storage position in dashed lines. It is recognized that the cook top of the cooking appliance may be substantially horizontal in its use position and substantially vertical in its storage or non-use position. When the cook top of the cooking appliance 10 is folded up to its non-use position, the underside of the cook top is used as a display for displaying time and/or other information as previously described.

To facilitate the movement of the cook top 20 of the cooking appliance 10 between the use and non-use positions, it is recognized that a number of different structural configurations may be used. In a first arrangement, the rear 50 of the cooking appliance 10 may include a rail 52. The rail 52 may include a hinge (not shown) that enables the pivoting of the cook top between the two positions. Detents or stops may be used to fix the cook top in the use and non-use position. If desired, the rail 52 may be attached to a wall in the cooking area. When it is attached to a wall the cooking area, the cook top 20 faces the wall in the non-use position so that the display 24 is visible.

In lieu of the hinge arrangement, the rear rail 52 may be shaped so that its bottom surface shape safely maintains the cooking appliance 10 in a stable position regardless of whether the cook top is in the horizontal use or vertical storage positions. That is, in this arrangement, the rear rail 52 would rotate as well. If desired, cushioning elements, such as compressible rubber members, may be provided on the bottom and top surfaces of the cooking appliance 10.

Additionally, the shape of the cook top on the sides provides a small gap to enable the user to grab the edges and use them as handles to fold up and to fold down the cook top.

Figure 5:
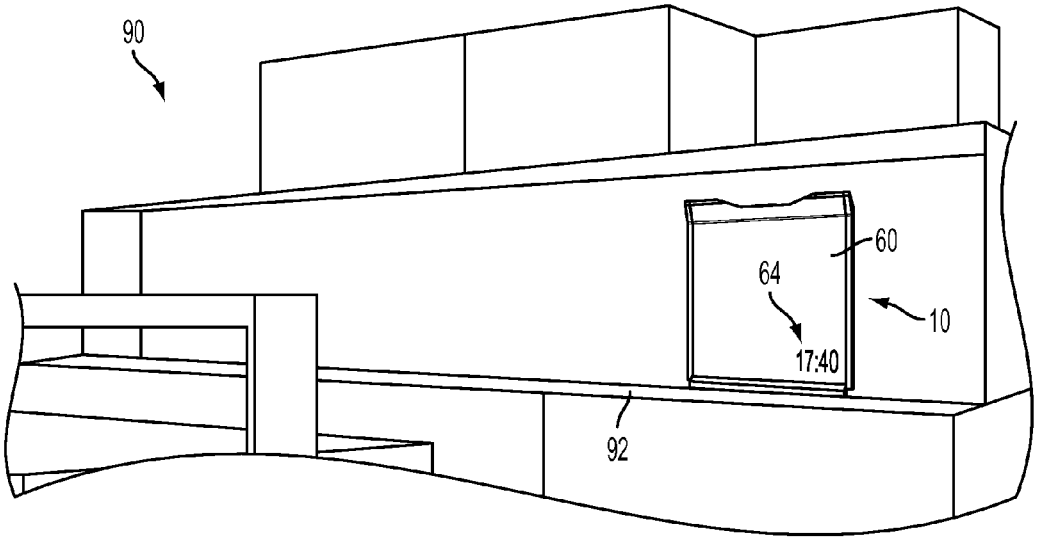
FIG. 5 is a perspective view of the cooking appliance shown on a shelving unit.

Additionally, the cooking appliance 10 is portable. Accordingly, if it is not fixed to a wall, it can easily be moved to another area and used as an aesthetic clock with the display 24 exposed. FIG. 5 depicts such a use with the cooking appliance 10 on a supporting surface 92 of a shelving unit 90. If desired, the cooking appliance 10 may also be moved to a horizontal position and used while on a shelving unit should the shelving unit have suitable support.

Accordingly, the cooking appliance 10 provides users with more space to prepare their food and to make them more comfortable during the cooking process. This is particularly beneficial with users residing in small living quarters. If the user only has a very small amount of counter space, the cooking appliance 10 maybe placed in a vertical position to maximize the counter space for ingredient preparation such as the chopping or cutting of food. When the ingredients are prepared, the cook top 20 can be moved to its horizontal use position for food cooking. When the cooking process has been completed, the cook top 20 may be moved to a storage or vertical position to again increase the countertop space. In the non-use vertical position, the display on the underside may include a clock to provide meaningful information.

Utilizing an induction cooking system with cooking appliance 10 is beneficial because it is a low-energy consumption system. Additionally, it minimizes heat retained on the cook top surface 20 which is beneficial should the user want to move the cook top 20 to the non-use vertical position shortly after cooking. However, alternative cooking devices may be used in lieu of the induction system.

Further, the data reader 42 also aids the user in the cooking process. For example, it provides cooking defaults and lets the user accept the cooking data settings associated with a product package or modify those defaults. This can be particularly helpful for users with limited time or have little cooking experience.

While the present invention has been described with reference to exemplary embodiments, it will be understood by those of ordinary skill in the art that various changes may be made and equivalents may be substituted for elements thereof without departing from the scope of the invention. In addition, many modifications may be made to adapt a particular situation or material to the teachings of the invention without departing from the scope thereof. Therefore, it is intended that the invention not be limited to the particular embodiments disclosed, but that the invention will include all embodiments falling within the scope of the appended claims.

What is claimed is:

1. A cooking appliance comprising: a cook top having a cooking area on a top side and an electronic information display integrated with the cook to on a bottom side thereof, wherein the cook top is movable between a substantially horizontal use position for using the cooking area and an upstanding non-cooking position which exposes the display.

2. The cooking appliance according to claim 1, further comprising a rear rail having a hinge, and wherein the cook top pivots about the hinge.

3. The cooking appliance according to claim 1, wherein the electronic information display includes a clock.

4. The cooking appliance according to claim 3, further comprising an induction cooking device.

5. The cooking appliance according to claim 1, further comprising a data reader enabling the acquisition of data from food product packaging.

6. The cooking appliance according to claim 5, wherein the data reader is a RFID reader.

7. The cooking appliance according to claim 1, wherein the cooking top is substantially vertical in its upstanding non-cooking position.

8. The cooking appliance according to claim 7, further comprising an induction cooking device having multiple cooking areas.

9. The cooking appliance according to claim 8, further comprising an RFID reader.

10. The cooking appliance according to claim 9, wherein the electronic information display includes a clock.

11. The cooking appliance according to claim 9, further comprising a planar surface containing the cooking area, the planar surface further including a second electronic information display providing information corresponding to data acquired by the RFID reader.

* * * * *